US010759569B2

(12) United States Patent
Sprehe et al.

(10) Patent No.: US 10,759,569 B2
(45) Date of Patent: Sep. 1, 2020

(54) ARTICLE AND METHOD OF A RECLOSABLE ZIPPER HAVING TAMPER-EVIDENT FEATURES

(71) Applicant: Com-Pac International, Inc., Carbondale, IL (US)

(72) Inventors: Gregory S. Sprehe, Marion, IL (US); Donald K. Wright, Murphysboro, IL (US); Christopher L. Pemberton, Marion, IL (US)

(73) Assignee: COM-PAC INTERNATIONAL, INC., Carbondale, IL (US)

( * ) Notice: Subject to any disclaimer, the term of this patent is extended or adjusted under 35 U.S.C. 154(b) by 0 days.

(21) Appl. No.: 16/535,923

(22) Filed: Aug. 8, 2019

(65) Prior Publication Data

US 2019/0382164 A1 Dec. 19, 2019

Related U.S. Application Data

(63) Continuation of application No. 14/929,280, filed on Oct. 31, 2015, now Pat. No. 10,384,835.

(60) Provisional application No. 62/074,021, filed on Nov. 1, 2014.

(51) Int. Cl.
*B65D 33/25* (2006.01)

(52) U.S. Cl.
CPC ..... *B65D 33/2525* (2013.01)

(58) Field of Classification Search
CPC .. B65D 33/2525; B65D 33/2566; A44B 19/42
See application file for complete search history.

(56) References Cited

U.S. PATENT DOCUMENTS 3,198,228 A * 8/1965 Naito ..... B65D 33/24 383/65
4,796,300 A * 1/1989 Branson ..... B29C 37/0082 24/462
5,063,639 A * 11/1991 Boeckmann ..... B29C 65/08 156/66
5,749,658 A * 5/1998 Kettner ..... B29C 48/12 383/204
6,691,383 B2 * 2/2004 Linton ..... B65D 33/2516 156/66
6,901,637 B2 * 6/2005 Machacek ..... B65D 33/2525 24/30.5 R
6,954,969 B1 10/2005 Sprehe
(Continued)

*Primary Examiner* — Jason W San
(74) *Attorney, Agent, or Firm* — Sandberg Phoenix & von Gontard, P.C.

(57) ABSTRACT

A reclosable plastic zipper assembly, method of mounting and method of manufacturing of such, wherein the assembly has a ribbon with a first zipper strip profile and a second zipper strip profile, the first zipper strip profile includes at least one rib, and where the second zipper strip profile includes at least one recess, with the at least one rib and the at least one recess having complementary mating shapes for mating along the length of the plastic zipper assembly, the reclosable plastic zipper assembly also having a bead and a pair of perforations and the zipper strip profiles being capable of mating by folding the ribbon along the length of the plastic zipper assembly around the bead, and having a first perforation on the ribbon between the bead and the first zipper profile and a second perforation on the ribbon between the bead and second zipper profile.

17 Claims, 7 Drawing Sheets

(56) References Cited

U.S. PATENT DOCUMENTS 7,036,988 B2 * 5/2006 Olechowski ..... B65D 33/20 383/103
7,137,736 B2 * 11/2006 Pawloski ..... B65D 33/2541 383/61.2
7,147,374 B2 * 12/2006 Ajootian ..... A45C 11/008 383/13
7,260,871 B2 * 8/2007 Borchardt ..... B65D 33/2541 24/399
7,337,507 B2 3/2008 Wright et al.
7,467,893 B2 12/2008 Sprehe
7,553,082 B2 * 6/2009 Yoder ..... B65D 33/20 383/210.1
7,556,429 B2 * 7/2009 Taheri ..... B65D 31/12 383/38
7,674,039 B2 * 3/2010 McMahon ..... B65D 33/20 383/103
7,674,040 B2 * 3/2010 Dowd ..... B65D 33/2508 383/61.2
7,793,391 B2 9/2010 Sprehe
7,914,208 B2 3/2011 Sprehe
8,215,839 B2 * 7/2012 Borchardt ..... B65D 33/255 24/585.12
8,282,279 B2 * 10/2012 Coonce ..... B65D 33/2541 24/585.12
8,469,593 B2 * 6/2013 Price ..... B65D 33/2558 24/399
8,549,713 B2 * 10/2013 Anzini ..... B65D 33/2516 24/30.5 R
9,260,225 B2 * 2/2016 Anzini ..... B65D 33/2558
9,790,002 B2 * 10/2017 Tseng ..... B65D 33/007
10,099,818 B2 10/2018 Sprehe
2004/0047524 A1 * 3/2004 Stolmeier ..... B65B 9/20 383/210
2004/0261229 A1 * 12/2004 Cisek ..... B65D 33/255 24/389
2005/0008266 A1 * 1/2005 Crunkleton ..... B65B 61/188 383/5
2006/0008184 A1 * 1/2006 Borchardt ..... B65D 33/255 383/63
2008/0226203 A1 * 9/2008 Dais ..... B65D 33/2541 383/63
2010/0299881 A1 * 12/2010 Borchardt ..... B65D 33/255 24/30.5 R
2012/0051670 A1 * 3/2012 Matias ..... A61M 1/066 383/61.3
2013/0195385 A1 * 8/2013 Matias ..... B65D 33/2591 383/64
2016/0101904 A1 * 4/2016 Takigawa ..... B65D 33/2566 24/30.5 R
2016/0122086 A1 * 5/2016 Sprehe ..... B65D 33/2508 383/65
2018/0127156 A1 * 5/2018 Miyake ..... B65D 33/2525

* cited by examiner

PRIOR ART
FIGURE 1A
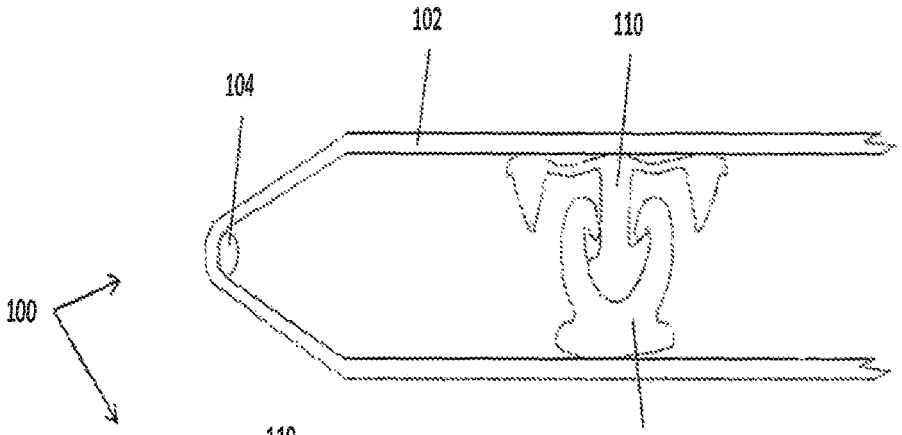
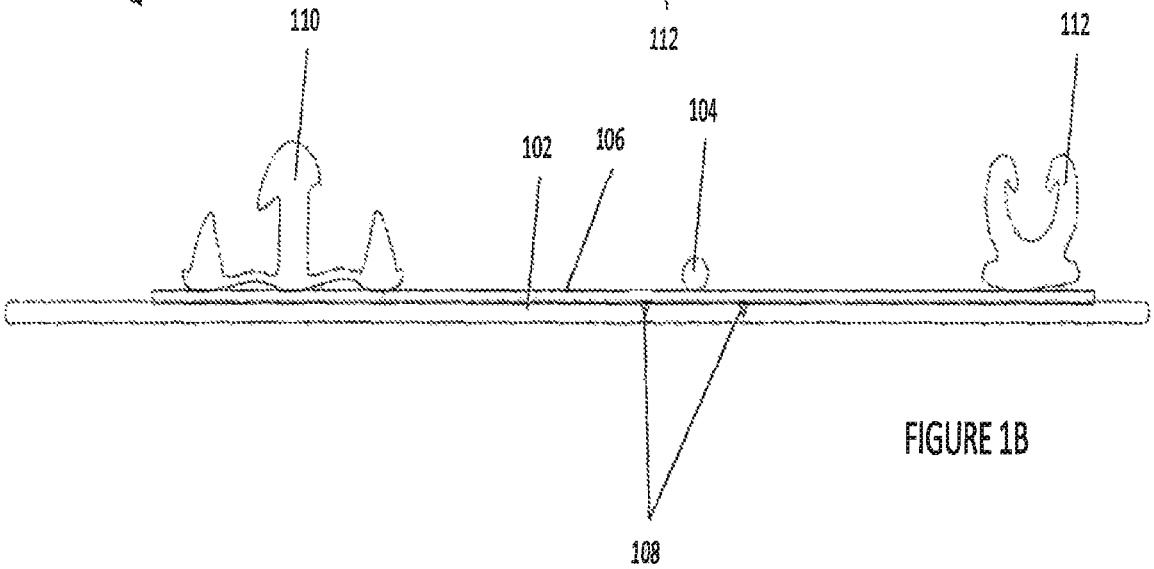
FIGURE 1B

ARTICLE AND METHOD OF A RECLOSABLE ZIPPER HAVING TAMPER-EVIDENT FEATURES

CROSS-REFERENCE TO RELATED APPLICATIONS

This application is a continuation of U.S. application Ser. No. 14/929,280 that will issue as U.S. Pat. No. 10,384,835 on Aug. 20, 2019; which claimed priority to U.S. Provisional Patent Application 62/074,021, filed Nov. 1, 2014. The disclosures of which are incorporated herein by reference.

FIELD

The present disclosure relates to a reclosable zipper apparatus and, more specifically, to a zipper apparatus that is constructed of plastic and having tamper-evident features and which may be affixed to the top of bags and permit resealable access to the contents therein.

BACKGROUND

The statements in this section merely provide background information related to the disclosure and do not necessarily constitute prior art.

Extruded plastic zipper profiles are known in the art, including those with tamper-evident features. For example, a prior art configuration of a reclosable zipper apparatus can be seen in FIGS. 1A and 1B. However, the manufacturing of that example apparatus and others could be improved upon in a variety of ways.

SUMMARY

A new reclosable zipper assembly having tamper-evident features is disclosed. The assembly is extruded in a single piece from a die. The assembly includes a pair of complementary reclosure profiles on a ribbon, as well as a bead situated between the reclosure profiles and perforation lines on either side of the bead. The ribbon may be folded about the bead and the complementary reclosure profiles mated to form a reclosure zipper assembly that may be mounted atop bags to provide resealable entry into the inside of the bag, as well as evidence of any tampering with the bag's contents. A variety of reclosure profiles or arrangements may be used, and optionally a hinge may be employed on one or more of the reclosure profiles. The zipper assembly may be affixed to a bag or pouch in a variety of manners, including a transverse heat seal or adhesive.

BRIEF DESCRIPTION OF THE DRAWINGS

FIG. 1A depicts a profile view of a folded and mated tamper evident zipper apparatus of the prior art.

FIG. 1B depicts a profile view of the tamper evident zipper apparatus of FIG. 1A, this figure showing the apparatus unfolded.

DETAILED DESCRIPTION

Figure 2:
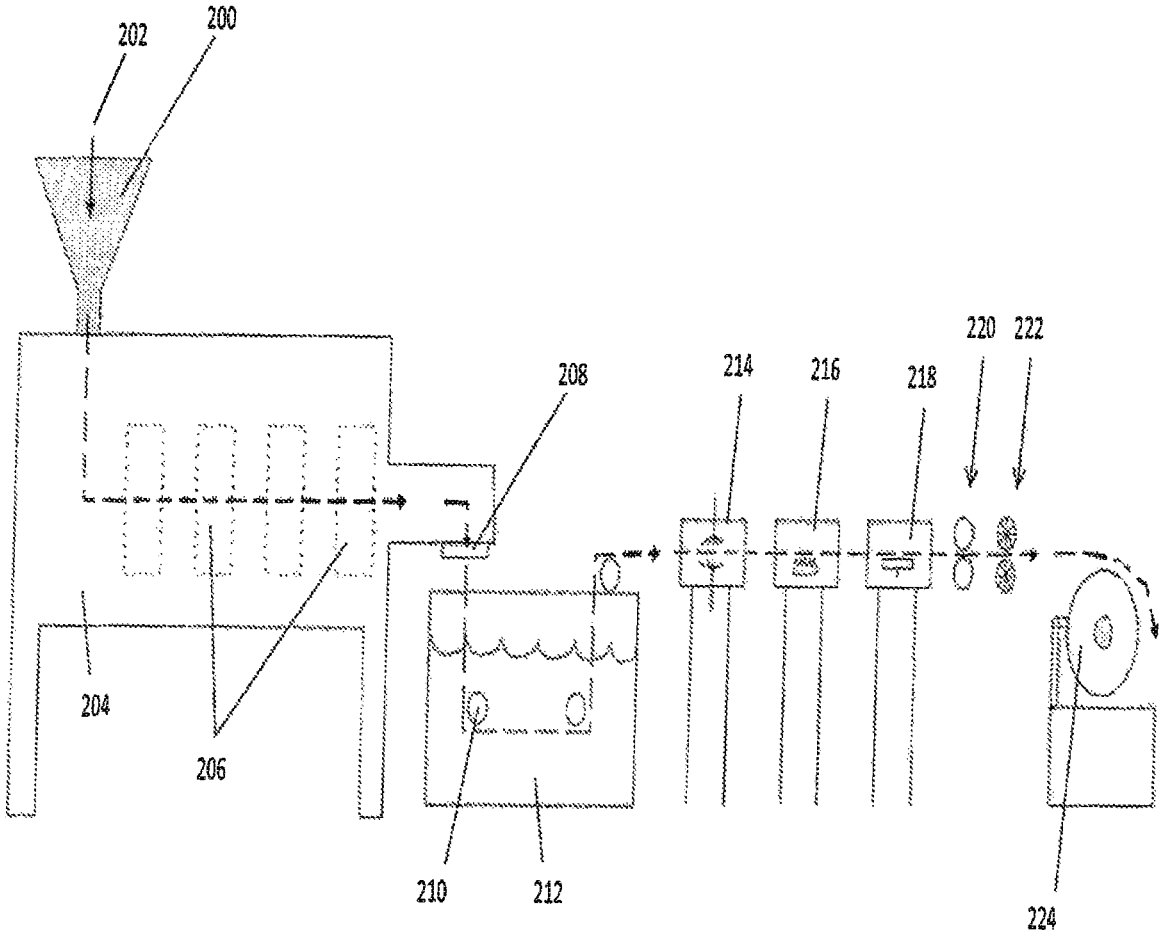
FIG. 2 depicts a not-to-scale schematic of an embodiment of a manufacturing process of the zipper assembly of the disclosure.

The following description of various embodiments is merely exemplary in nature and is in no way intended to limit the invention, its application, or its uses.

A new resealable zipper assembly of indefinite length is disclosed, this zipper having tamper-evident features. The new zipper assembly may be compared to a prior art assembly, as seen in FIGS. 1A and 1B. That prior art zipper assembly 100, occasionally referred to in the art as "zipper tape", is shown in a cross-sectional profile view, where FIG. 1A shows a folded and mated zipper tape cross section and FIG. 1B shows an unfolded flat zipper tape cross section. The prior art assembly includes a plastic ribbon or strip 102 and a bead 104, where the bead may be grasped by a user to open the assembly by tearing off the bead 104 and portion of the strip 102 above the two perforations 108 that run the length of the assembly. Affixed to the strip 102 is a perforated membrane cap 106, onto which is affixed a zipper profile in both male 110 and female 112, or rib and recess, respectively, zipper profile components.

To manufacture the prior art assembly of FIGS. 1A and 1B, a manufacturer may extrude (or purchase or otherwise provide) the male rib 110, the female recess 112, and the bead 104 each separately and then mount those onto a membrane cap 106, which is then mounted onto a perforated 108 strip 102. The membrane cap 106 may be omitted in some applications. Then the flat assembly 100 of FIG. 1B may be folded into the assembly 100 of FIG. 1A about the bead 104 such that the rib 110 and recess 112 mate to complete the zipper profile. This assembly 100 may then be spooled for storage or shipment. The assembly strip may be unspooled and cut into segments for mounting onto the top of bags where a resealable assembly with a tamper-evident feature is desired, among other uses.

In contrast to the prior art zipper tape of FIGS. 1A and 1B, a new resealable zipper assembly is disclosed, one that may be extruded through a single die, saving raw material, steps, and time, among other benefits.

Turning to the remainder of the figures, FIG. 2 shows an embodiment of a manufacturing process of the disclosed zipper assembly, where the dashed line shows the path of the product from raw material to finished product. In this example, an extruder blender 200 may accept one or more polymer resins 202. Those blended resins are fed into a polymer extruder 204, the extruder having a series of heat zones 206 therein, the heat zones serving the purpose of creating a substantially consistent blend of polymers for extrusion through a single die 208 at the end of the extruder. Once extruded through the die, the zipper assembly passes around one or more spools 210 that guide it through a cooling bath 212 and into a compressed air dryer 214, followed by a flame treater 216, and optionally a printer 218 where one or more colors may be printed onto the assembly for commercial packaging, depending on the application of the end user. Finally, the assembly may be mechanically folded and mated 220 and perforated 222 before being fed onto a spool 224 for shipment or storage. Those of skill in the art will recognize that a variety of other steps may be included, and some may be omitted, to create the disclosed zipper strip assembly. The embodiment of FIG. 2 is not intended to be limiting, but merely illustrative of a possible manufacturing process.

The zipper may be extruded through the die from a variety of plastic raw materials, including for example polyethylene, polypropylene, polyethylene terephthalate, or other suitable plastics know in the art, or any blend thereof in a variety of ratios. The plastic may include additional additive materials such as ethylene acetate, and/or any other suitable additive know in the art, depending on desired performance and/or specifications of the zipper assembly. In some applications, colorants may be added to the plastic raw material.

Figure 3:
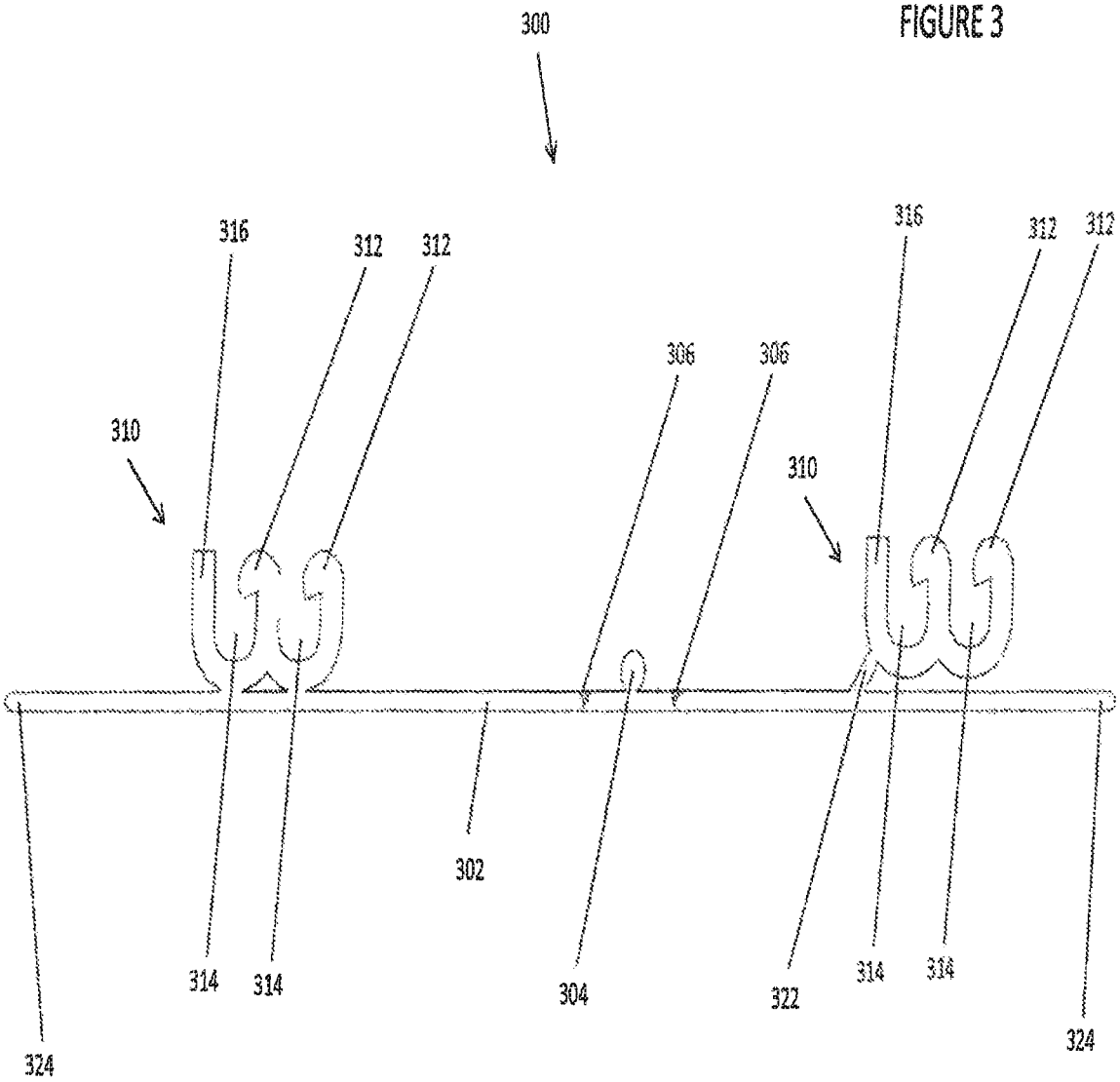
FIG. 3 shows a profile view of an embodiment of the zipper of the disclosure, this figure showing the zipper unfolded, where this zipper includes an optional hinge on one of the zipper profiles.

FIG. 3 shows an embodiment of the tamper-evident resealable zipper assembly 300 of the disclosure, the assembly including a ribbon 302 having distal ends 324, as well as a bead 304, where a pair of perforations 306 is present on the ribbon, one perforation on either side of the bead. In an embodiment, as seen in FIG. 3, the perforations 306 are substantially equidistant from the bead 304. The assembly 300 further includes a pair of zipper strip profiles 310 that are complementary in shape such that the assembly 300 may be folded at or near the bead 304 and the two profiles may mate to provide a seal along the length of the assembly. This mated configuration can be seen in subsequent figures.

These complementary interlocking profiles may be resealably opened and closed, and may optionally provide an airtight and/or watertight seal along the length of the zipper assembly, such that, when mounted on a package, the package may provide an airtight seal for the contents of the package.

Each profile may include one or more ribs 312 and one or more recesses 314, where the ribs 312 may optionally be hooked or include some other type of physical feature that enhance the profile-to-profile grip strength. Each profile may include a non-locking rib 316 that does not fit into a recess 314 when the profiles are mated. Each recess 314 is defined by the space between adjacent ribs 312 or a rib and a non-locking rib 316.

An optional hinge 322 is shown in the embodiment seen in FIG. 3. When the zipper assembly 300 is mounted on the top of a bag, the hinge 322, when present, prevents the opening of the bag by forces from within the bag. For example, a bag containing heavy or bulky items might burst open from internal forces pulling apart the zipper profiles when the bag is held upside down (with the zipper facing the ground). Such zipper failure could result in the product, which may in an embodiment be food, hitting the ground. A hinge allows the mated zipper profile to rotate about the hinge when internal forces push upwardly against the zipper assembly, greatly increasing the forces needed to open the bag from below the zipper profiles, whether those forces are internal from the contents of the bag, or from someone attempting to open the bag by pulling the two side walls of the bag apart below the mated zipper strips.

As can be seen in FIG. 3, a hinge 322 is a bridge of material that separates one of the zipper profiles 310 from the ribbon 302. This physical configuration in part enables the zipper assembly to achieve the resistance to opening in the face of internal forces. This hinge, having extruded with the remainder of the assembly through a single die, provides additional strength over prior art hinged zippers that are assembled from a plurality of components, such as those in FIGS. 1A and 1B.

Figure 4:
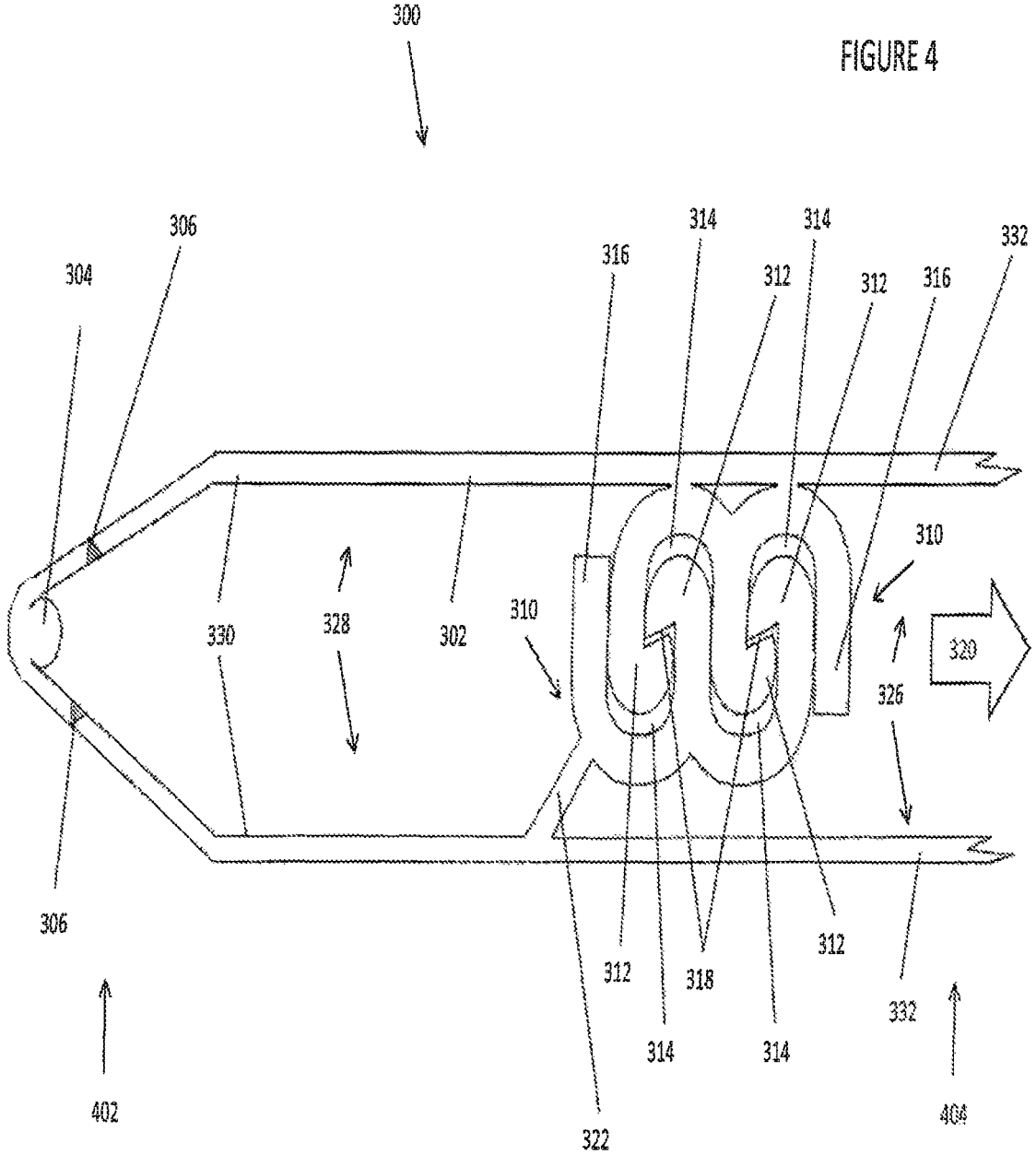
FIG. 4 shows a profile view of the embodiment of the zipper of FIG. 3, this zipper having been folded such that the zipper profiles are mated.

FIG. 4 shows the tamper-evident resealable zipper assembly of FIG. 3, where the assembly 300 has been folded about the bead 304 and the profiles 310 have been mated to create the complementary profile-to-profile seal. In this particular embodiment, each rib contains a hook-like shape. Thus the rib 312 to recess 314 connection includes a hook closure region 318 that provides additional gripping strength of the assembly. The complementary hook surfaces that meet at a hook closure region 318 to provide a snug closure and improved seal over many conventional reclosure mechanisms. With the profiles 310 mated, distinct regions above the profile 328 and below the profile 326 are created. Additionally, the folded assembly of FIG. 4 has a perforated end 402 near the bead 304 and an open end 404 distal from the bead.

In the region below the profile 326 in FIG. 4, the ribbon 302 has been folded such that two lower flanges 332 are present, these flanges terminating at the ends 324 of the assembly. These flanges may be sealed to the top of a bag to provide a user access to the interior and/or contents 320 of the bag. These lower flanges may 332 be affixed to the upper bag walls by placing the flanges outside the bag walls, whereby the zipper assembly essentially caps the bag opening. Alternatively, the flanges may be placed inside the bag and sealed to the upper portions of the bag walls. A heat seal, or hot melt adhesive, or any other suitable conventional mechanism may be used to affix the assembly of this disclosure to the top of a bag. This disclosure embraces a multitude of mechanisms for attaching an assembly to a bag as well as a variety of spatial relationships between the lower flanges and the upper bag walls, provided that the zipper assembly provides access through the opened yet resealable zipper to the inner contents of the bag or pouch.

The package onto which the zipper is mounted may be a bag or other flexible pouch or container, and may itself be constructed of one or more ply of plastic films or other suitable materials. In an embodiment, the package is constructed of such a material that a heat seal may be made between the zipper strips at their lower flanges and upper edges of the walls of the package. Such a construction may include a plastic bag or a multi-layered bag with an innermost plastic film layer. In another embodiment, the package may be suitable for a hot melt or other adhesive seal between the zipper strips and the upper edges of the walls of the package. Such a construction may include bags constructed of kraft paper or clay coated paper.

To open a bag onto which the assembly 300 has been affixed, a user may first grasp a portion of the bead 304 and pull it away from the rest of the assembly, thereby removing the portion of the assembly along and between the two perforations 306. This action creates two upper flanges 330 in the region above the profile 328 and access to the zipper profiles 310. The user would then grasp the two upper flanges 330 and pull apart, thereby disengaging the profiles 310 from one another and granting the user access to the contents of the bag 320. To reseal the bag, the user may run a thumb and finger along the outside of the ribbon 302 from one end of the assembly to the other along the length of the top of the bag and thereby zip the package closed as a user would do with most a conventional resealable zipper.

Though the term perforation is used herein, it should be understood that the perforations may be hashed linear punctures along the length of the ribbon, or may be some other partial deformation or cutting of the ribbon material, such that the pulling of the bead and surrounding ribbon will tear away a portion of the assembly to grant the user access to the region above the profile and access to the zipper profiles. Any suitable perforation or similar deformation or incomplete cutting of the ribbon is embraced by the use of the term perforation.

Though not seen in the figures, a crimp seal or other mechanism for terminating and sealing off the ends of the zipper assembly may be present at each distal end of a segment of the reclosable plastic zipper assembly of indefinite length. When present, such a termination may extend downwardly through the lower flanges 312 such that the termination and heat seal in combination provide a substantially complete seal between the interior of the bag and the outside environment.

Figure 5:
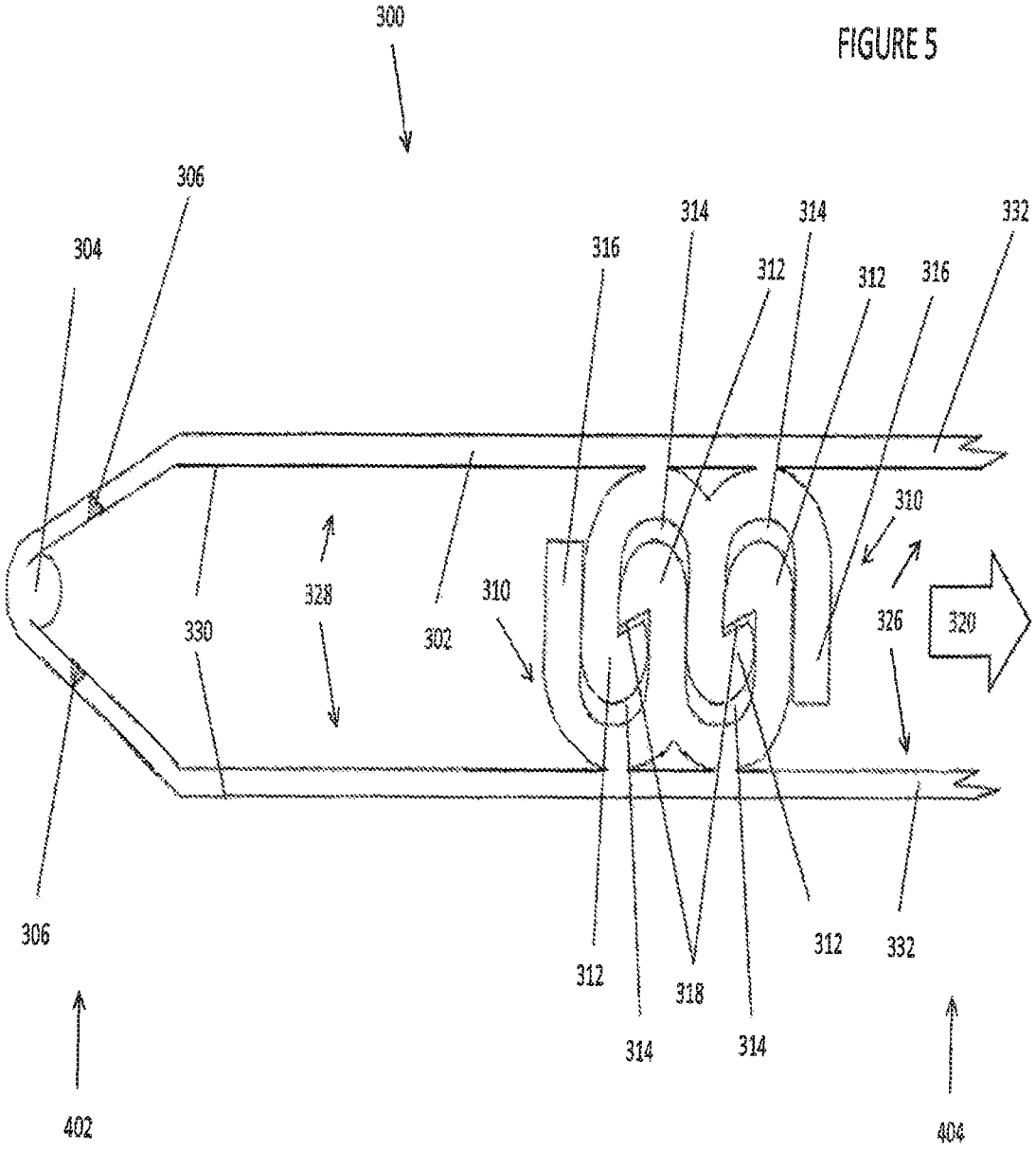
FIG. 5 shows a profile view of an alternate embodiment of the zipper of the disclosure, this zipper having been folded such that the zipper profiles are mated, this zipper lacking an optional hinge feature.

FIG. 5 shows a different embodiment of the tamper-evident resealable zipper assembly, as compared to that of FIG. 4. The assembly 300 has been folded about the bead 304 and the profiles 310 have been mated to create the complementary profile-to-profile seal, however no hinge is present in the configuration seen in FIG. 5. This embodiment has a similar opening mechanism to that of FIG. 4, though it does not have the same level of ability to withstand opening from forces within the bag or from grabbing the lower flanges 332 or bag walls to open.

Figure 6:
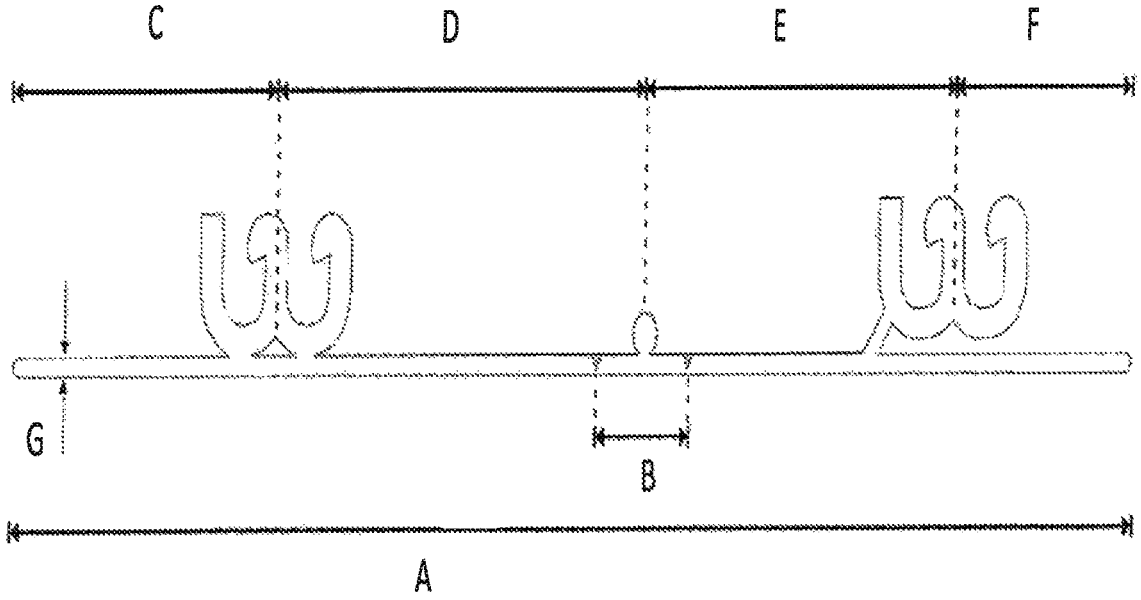
FIG. 6 shows the profile view of 3, with indications of various spatial arrangements, as will be discussed in the Detailed Description.

FIG. 6 shows the same unfolded embodiment of the assembly as in FIG. 3, though certain spatial relationships are seen to illustrate the assembly further. Viewing FIGS. 3 and 6 together, as previously discussed, though the bead 304 is shown at the center of the length of the unfolded assembly between the two distal ends 324 of the ribbon A, this disclosure should not be so limiting. In an embodiment, a manufacturer may desire to have one lower flange 332 longer than the other, at which point the bead may be off center of the length A. Thus C+D doesn't necessarily always equal E+F. Similarly, though the bead is shown at the midpoint of the line B between the two perforations 306, it might be desirable to have two upper flanges 330 of differing lengths.

It should be noted that, due to the rib 312 and recess 314 relationship of the two profiles 310, the midpoint of one profile may be further from the bead than the midpoint of the other profile, as can be seen when comparing lines D and E. Similarly, the distance between the midpoints of the profiles and their respective adjacent edges of the ribbon will not be equal, as can be seen when comparing lines C and F, where the bead is at the midpoint of line A. The thickness of the ribbon G may be of any suitable depth, depending on the application of the manufacturer.

Figure 7:
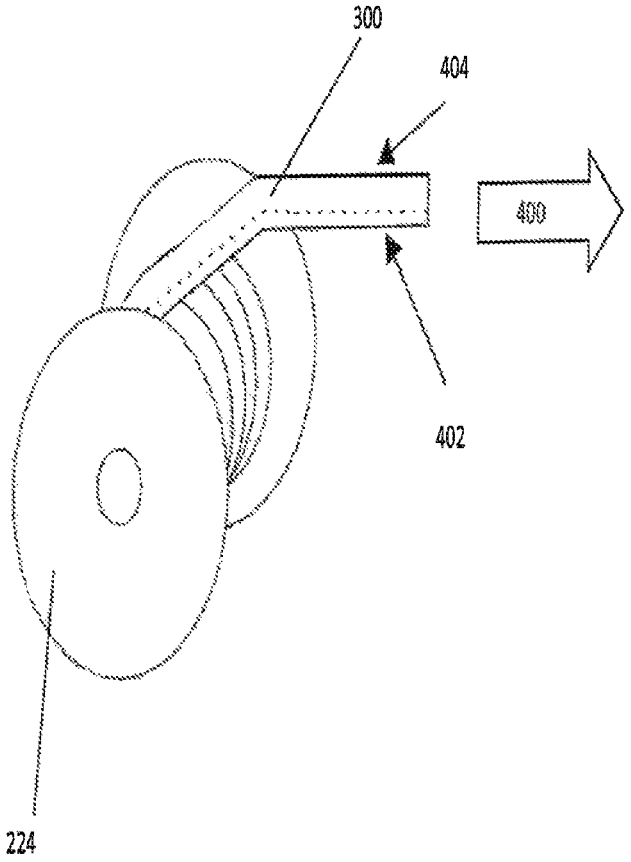
FIG. 7 shows an embodiment of unspooling of the zipper of the disclosure, for example where the zipper is being unspooled for cutting into segments and attachment to a product, such as a bag.

FIG. 7 demonstrates an embodiment of the unspooling of the assembly 300, where a spool 224 may be present at or near an in-line bag forming machine or other similar device, and the assembly may be unspooled in a direction 400 with the perforated end 402 down and the open end 404 up. In this embodiment, the assembly is fed to an in-line bag machine such that the assembly is affixed to the top of a bag that is upside down. In such an application, a subsequent step in the manufacturing process might include the filling of the unfinished bag with foodstuffs or other material, followed by a crimping or other sealing of the bottom of the bag to complete the production. Any suitable mechanism for unspooling and feeding the assembly is embraced by this disclosure, including spooling the assembly in an unfolded state, as seen in FIG. 3, or in a folded state, as seen in FIGS. 4 and 5.

In an embodiment, a continuous spool of the zipper assembly 300 of the disclosure is integrated into an in-line bag manufacturing machine. An example of such a machine is one where rolled plastic film is folded, sealed, and cut into bags. Those bags may have the zipper attached to the bag via heat seal or hot melt adhesive or other conventional zipper-to-bag attachment processes. The resulting product is a bag having the disclosed zipper assembly attached thereon.

The zipper profile of FIG. 4 was subjected to repeated drop testing, shake testing, and opening force (both internal and external) testing. These tests were run against the prior art zipper of FIG. 1A.

In the drop test, a plastic bag with the assembly of FIG. 4 affixed to the top end and having an open bottom end was mounted on and clamped to a weight release testing apparatus by its open end. Five pounds of weight were dropped into the open bottom end, as might happen during the filling of bags having the disclosed apparatus mounted thereon. In ten tests, the bag having the assembly of FIG. 4 attached thereto passed, where a pass is defined as the zipper profiles remaining mated. Control bags having the assemblies of FIG. 1A mounted thereon passed only seven of ten drop tests.

In the shake test, a plastic bag with the assembly of FIG. 4 affixed to the top end and having an five pounds of weight therein with a closed bottom end were shaken smartly upside down (with the zipper facing the ground) three times in rapid succession. In ten tests, the bag having the assembly of FIG. 4 attached thereto passed, where a pass is defined as the zipper profiles remaining mated.

Control bags having conventional the assemblies of FIG. 1A mounted thereon passed only seven of ten drop tests.

For the internal opening force tests, the assembly of FIG. 4 was subjected to a tensile testing apparatus, where the force was applied from the region below the profile 326, to simulate product attempting to escape from within the bag. This test assembly had a ribbon thickness G of 0.0035 inches. Table 1 below shows the internal opening pound force (LbF) required to separate the mated profiles for ten different samples of the FIG. 4 assembly, as well as ten reclosure profiles of FIG. 1A for comparison.

| Sample Number | FIG. 4 Assembly | FIG. 1A Assembly |
|---|---|---|
| 1 | 12.36 | 9.13 |
| 2 | 12.95 | 2.59 |
| 3 | 10.86 | 2.98 |
| 4 | 10.80 | 8.91 |
| 5 | 13.06 | 2.20 |
| 6 | 7.77 | 4.52 |
| 7 | 11.56 | 7.02 |
| 8 | 9.06 | 4.80 |
| 9 | 13.09 | 2.26 |
| 10 | 10.72 | 7.89 |
| Maximum | 13.09 | 9.13 |
| Minimum | 7.77 | 2.20 |
| Mean | 11.22 | 5.23 |

Thus the assembly of the disclosure as seen in FIG. 4 is, on average, more than twice as resistant against internal opening forces as compared to FIG. 1A.

For the external opening force tests, the assembly of FIG. 4 was subjected to a tensile testing apparatus, where the force was applied from the region above the profile 328, where the bead had been removed via the perforations, to simulate a user attempting to gain access to the contents of the bag 320. This test assembly had a ribbon thickness G of 0.0035 inches. Table 1 below shows the internal opening pound force (LbF) required to separate the mated profiles for ten different samples of the FIG. 4 assembly, as well as ten profiles as seen in FIG. 1A for comparison.

| Sample Number | FIG. 4 Assembly | FIG. IA Assembly |
|---|---|---|
| 1 | 0.43 | 1.12 |
| 2 | 0.4 | 1.40 |
| 3 | 0.48 | 0.64 |
| 4 | 0.45 | 2.47 |
| 5 | 0.46 | 2.87 |
| 6 | 0.48 | 0.37 |
| 7 | 0.49 | 1.84 |
| 8 | 0.40 | 0.90 |
| 9 | 0.54 | 0.51 |
| 10 | 0.48 | 2.35 |
| Maximum | 0.54 | 2.87 |
| Minimum | 0.40 | 0.37 |
| Mean | 0.47 | 1.45 |

Thus the assembly of the disclosure as seen in FIG. 4 is, on average, easier for a user to open from the top as compared to conventional reclosable zippers as seen in FIG. 1A.

For both types of zipper assemblies, it is easier to open from the top than from the inside, but the assembly of FIG. 4 is more than twenty three times harder to open from the inside as it is from the outside, whereas for conventional zippers the factor is less than four times.

Thus, a reclosable plastic zipper assembly of indefinite length is disclosed, the assembly including a ribbon having a first zipper strip profile and a second zipper strip profile, where the first zipper strip profile includes at least one rib, and where the second zipper strip profile includes at least one recess. The at least one rib and at least one recess are complementary in shape such that the zipper strip profiles may be mated by inserting the at least one rib into the at least one recess along the length of the plastic zipper assembly. The reclosable plastic zipper assembly further include a bead and a pair of perforations, where the zipper strip profiles may be mated by folding the ribbon along the length of the plastic zipper assembly around the bead, where a first perforation is on the ribbon between the bead and the first zipper profile, and the second perforation is on the ribbon between the bead and second zipper profile, wherein the zipper assembly has been extruded through a single die.

A bag having a recloseable plastic zipper assembly is also disclosed, where the assembly is affixed to the upper bag walls by placing the flanges outside the bag walls, and thus the zipper assembly essentially caps the bag opening. In another embodiment, a bag is disclosed where the flanges may be placed inside the bag and sealed to the upper portions of the bag walls. A heat seal, or hot melt adhesive, or any other suitable conventional mechanism may be used to affix the assembly of this disclosure to the top of a bag.

It should be understood that the profile views seen in the figures are representative of any functional cross-section and run the length of the zipper assembly. Where the zipper assembly has been cut into segments, it may be desirable in some applications for a heat seal, for example in the form of a crimp or a pinch, to be present on the distal lateral ends of the zipper strips such that when the zipper assembly has been opened, the distal ends of the zipper assembly remain sealed and joined.

In an embodiment, the geometry and arrangement of the various protrusions and grooves, including any hooks thereon when present, may be substantially congruent to one another. In an embodiment, this congruency provides a substantially airtight and/or watertight seal along the length of the zipper.

A variety of reclosure profiles may be used in conjunction with the disclosed child resistant zipper assembly, including but not limited to those seen in U.S. Pat. Nos. 7,914,208 and/or 6,954,969, both assigned to Com-Pac International, Inc., the assignee of the present application. The entireties of U.S. Pat. Nos. 7,914,208 and 6,954,969 are hereby incorporated by reference.

The terms recloseable and resealable are used interchangeably herein. It would be understood by those of skill in the art that, as used herein, these terms generally refer to zipper assemblies that may be opened and closed repeatedly to form a substantially complete seal across the length of the zipper assembly.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention as well as all equivalents thereof.

What is claimed is:

1. A zipper assembly comprising:

a ribbon body having an indefinite length defined between opposing distal ends, a first zipper strip profile and a second zipper strip profile, and a bead between the profiles, wherein the first zipper strip profile includes at least one rib, and wherein the second zipper strip profile includes at least one recess, the at least one rib and the at least one recess being complementary in shape such that the zipper strip profiles are configured to be mated by folding the ribbon about the bead and inserting the at least one rib into the at least one recess along the length of the zipper assembly, the ribbon further including a pair of perforations, where a first perforation is between the bead and the first zipper profile, and the second perforation is between the bead and second zipper profile, wherein the zipper assembly is composed of a plastic material that has been extruded through a single die.

2. The zipper assembly of claim 1 wherein the first zipper strip profile has a plurality of ribs, and wherein the second zipper strip profile has a plurality of recesses.

3. The zipper assembly of claim 1, where the first zipper strip profile has a plurality of ribs and the second zipper strip profile has a plurality of ribs, where each recess on a zipper strip profile is defined by the space between adjacent ribs in a zipper strip profile, wherein at least one rib of the first zipper strip profile has a hook, and wherein at least one rib on the second zipper strip profile has a hook, such that, when the zipper strip profiles are mated by folding the ribbon about the bead and inserting the at least one rib into the at least one recess along the length of the zipper assembly, the hook of the first zipper strip profile mates with the hook of the second zipper strip profile along complementary hook surfaces.

4. The zipper strip assembly of claim 3, wherein the first zipper strip assembly has a plurality of hooks, and wherein the second zipper strip assembly has a plurality of hooks.

5. The zipper assembly of claim 1, wherein the plastic material is selected from a group consisting of polyethylene, polypropylene, polyethylene terephthalate, or any blend thereof.

6. The zipper assembly of claim 5, wherein the plastic material includes an ethylene acetate.

7. The zipper assembly of claim 5, wherein the plastic material further includes at least one colorant.

8. The zipper assembly of claim 1, the assembly being mounted on a package, such that the first zipper profile and second zipper profile is configured so that when mated along the length of the assembly, provides an airtight, watertight, or airtight and watertight seal for any contents of the package.

9. The zipper assembly of claim 8 wherein the first zipper strip profile includes a plurality of ribs, and wherein the second zipper strip profile includes a plurality of recesses.

10. The zipper assembly of claim 8, where the first zipper strip profile includes a plurality of ribs and the second zipper strip profile includes a plurality of ribs, where each recess on a zipper strip profile is defined by the space between adjacent ribs in a zipper strip profile, wherein at least one rib of the first zipper strip profile includes a hook, and wherein at least one rib on the second zipper strip profile includes a hook, such that, when the zipper strip profiles are mated by folding the ribbon about the bead and inserting the at least one rib into the at least one recess along the length of the zipper assembly, the hook of the first zipper strip profile mates with the hook of the second zipper strip profile along complementary hook surfaces.

11. The zipper strip assembly of claim 10, wherein the first zipper strip assembly includes a plurality of hooks, and wherein the second zipper strip assembly includes a plurality of hooks.

12. A zipper assembly comprising:

a ribbon body having an indefinite length defined between opposing distal ends, a first zipper strip profile and a second zipper strip profile, and a bead between the profiles, wherein the first zipper strip profile includes at least one rib, and wherein the second zipper strip profile includes at least one recess, where a recess on a zipper strip profile is defined by the space between adjacent ribs in a zipper strip profile, the at least one rib and the at least one recess being complementary in shape such that the zipper strip profiles are matable when folding the ribbon about the bead and inserting the at least one rib into the at least one recess along the length of the zipper assembly, the ribbon further including a pair of perforations, where a first perforation is between the bead and the first zipper profile, and the second perforation is between the bead and second zipper profile, the assembly further including a hinge, where a hinge is a bridge of material that separates one of the zipper profiles from the ribbon, wherein the ribbon body is configured from a plastic material that has been extruded through a single die.

13. The zipper assembly of claim 12 wherein the first zipper strip profile includes a plurality of ribs and recesses, and wherein the second zipper strip profile includes a plurality of ribs and recesses.

14. The zipper assembly of claim 12, wherein at least one rib of the first zipper strip profile includes a hook, and wherein at least one rib on the second zipper strip profile includes a hook, such that, when the zipper strip profiles are mated by folding the ribbon about the bead and inserting the at least one rib into the at least one recess along the length of the zipper assembly, the hook of the first zipper strip profile mates with the hook of the second zipper strip profile along complementary hook surfaces.

15. The zipper strip assembly of claim 14, wherein the first zipper strip assembly includes a plurality of hooks, and wherein the second zipper strip assembly includes a plurality of hooks.

16. The zipper assembly of claim 12, the assembly being mounted on a package, such that the first zipper profile and second zipper profile may, when mated along the length of the assembly, provide an airtight, watertight, or airtight and watertight seal for any contents of the package.

17. The zipper assembly of claim 12, the assembly being mounted on a package, such that, when internal forces from within the package are applied to the zipper assembly, the zipper profile that is separated from the ribbon via the hinge rotates at least partially about the hinge.

* * * * *